United States Patent [19]

Blackwell

[11] 4,281,975

[45] Aug. 4, 1981

[54] ANTI-FRICTION SLIDE VALVE SUPPORT FOR SCREW COMPRESSOR

[76] Inventor: Thomas D. Blackwell, 136 Monument Rd., York, Pa. 17403

[21] Appl. No.: 82,680

[22] Filed: Oct. 9, 1979

[51] Int. Cl.[3] ..... F04C 18/16; F04C 29/08; F16C 29/04

[52] U.S. Cl. ..... 418/201; 308/6 R

[58] Field of Search ..... 418/159, 197, 201-203; 308/6 R

[56] References Cited

U.S. PATENT DOCUMENTS

| | | | |
|---|---|---|---|
| 2,058,331 | 10/1936 | Long | 308/6 A |
| 2,352,911 | 7/1944 | Osplack | 308/6 R |
| 3,088,659 | 5/1963 | Nilsson et al. | 418/201 |
| 3,093,424 | 6/1963 | Pernetta | 308/6 R |
| 3,432,089 | 3/1969 | Schibbye | 418/201 |
| 3,734,653 | 5/1973 | Edstrom et al. | 418/201 |
| 3,738,780 | 6/1973 | Edstrom | 418/201 |
| 3,996,750 | 12/1976 | Brcar | 251/326 |
| 4,211,147 | 7/1980 | Panissidi et al. | 137/595 |

*Primary Examiner*—John J. Vrablik

*Attorney, Agent, or Firm*—C. Hercus Just

[57] ABSTRACT

A screw compressor including a coacting male and female rotor with respect to which a slide valve is operable to control the discharge of the compressor and also regulate the pressure of the fluid pumped or compressed thereby, the improvement comprising a limited number of different embodiments of anti-friction constructions for supporting the slide valve within the cylindrical bore provided therefor in the housing within which the male and female rotors operate, thereby minimizing the wear upon the slide valve within the bore therefor and minimizing the force required to move the slide valve.

7 Claims, 11 Drawing Figures

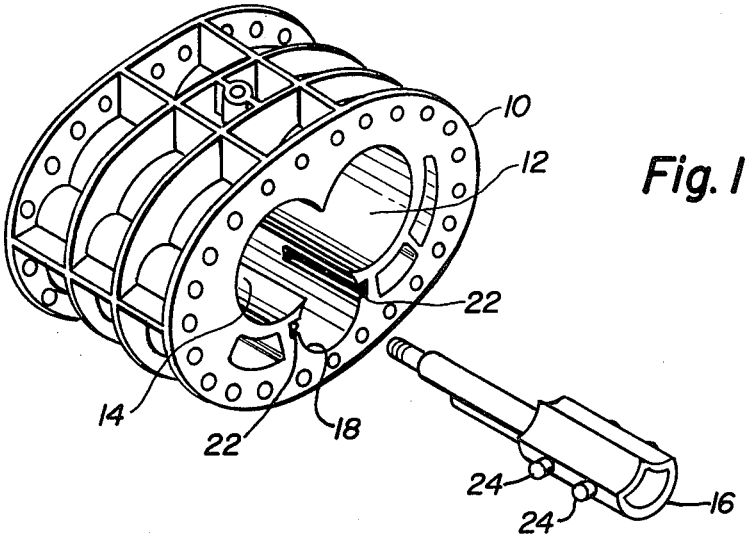
Fig. 1
Fig. 2
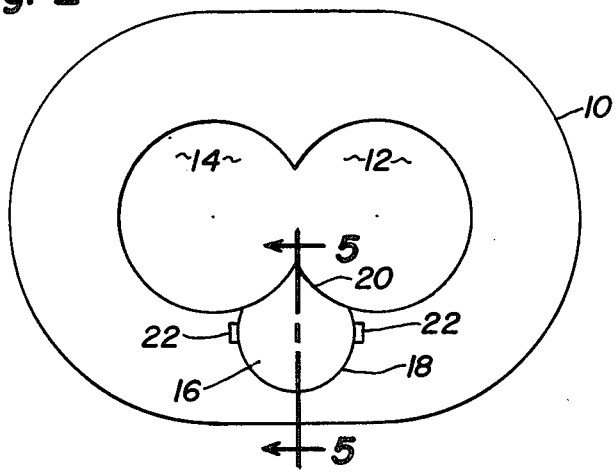
Fig. 3
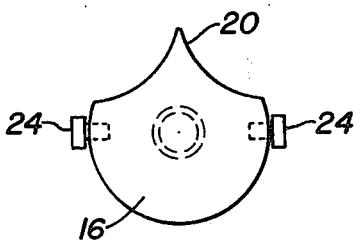
Fig. 4
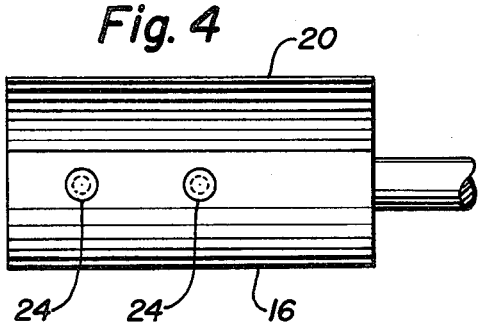
Fig. 5
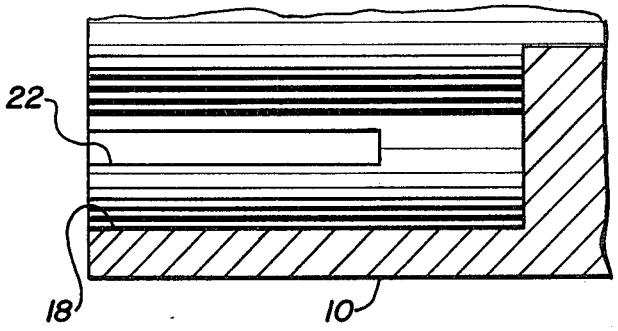

ANTI-FRICTION SLIDE VALVE SUPPORT FOR SCREW COMPRESSOR

BACKGROUND OF THE INVENTION

In its simplest form of a screw compressor which includes a slide valve, attention is directed to U.S. Pat. No. 3,088,659 to Nilsson et al, dated May 7, 1963, in which a pair of coacting male and female rotors are mounted on parallel axes and in the lower portion of the housing and intersecting the bores within which the rotors operate, a slide valve is mounted and is operated by a shaft extending from one end of the valve through the housing for operation by conventional means to regulate the pressure of the fluid compressed or pumped by the rotors. It will be seen from the disclosure of this patent that it is customary for the slide valves to be mounted within a cylindrical bore that intersects the cylindrical bores within which the male and female rotors operate. Due to the fact that very substantial pressures are exerted against the slide valve, there is a tendency for wear to develop between the surfaces of the slide valve which engage the cylindrical bore in which it is reciprocable for adjusting the operation of the compressor, particularly in regard to the pressures generated thereby as referred to above.

As far as has thus far been determined, the only attempt to minimize the friction and consequent wear normally occurring between a slide valve in a compressor of the aforementioned type and the cylindrical bore in which it operates, is disclosed in U.S. Pat. Nos. 3,734,653, to Edstrom et at, dated May 22, 1973, and 3,738,780, to Edstrom, dated June 12, 1973, the improvements offered by these patented constructions, however, pertaining to lubrication alone, rather than any attempt to provide anti-friction support or the like, as in the instant invention.

Further, various developments have been made heretofore with respect to guiding the slide valve of screw-type compressors and one such example is shown in prior U.S. Pat. No. 3,432,089 to Schibbye, dated Mar. 11, 1969, said patent being representative of a number of other patents disclosing various support and guide means for the slide valve but none of which have been found to include anti-friction means.

SUMMARY OF THE INVENTION

It is the principal object of the present invention to provide a limited number of embodiments of anti-friction means which have been designed to minimize the friction and wear between the slide valve of a screw-type compressor or pump and the cylindrical bore within which it is mounted, several of said embodiments including the formation of longitudinally extending guideways in opposite sides of the cylindrical bore for the reception of anti-friction means carried by corresponding opposite sides of the slide valve, one of such anti-friction means comprising rollers supported upon transverse axes perpendicular to the longitudinal axis of the slide valve and another embodiment including the formation of longitudinal grooves which are semi-circular in cross-section and respectively formed in the sidewalls of the cylindrical bore of the housing and opposite sides of the slide valve for the reception of spherical anti-friction members, such as ball bearings.

Still another object of the invention is to form arcuate grooves in the slide valve which are transverse to the longitudinal axis thereof and are spaced longitudinally along the slide valve, said grooves respectively being slightly less in depth than the diameter of spherical anti-friction balls and the like which are received therein, whereby the outermost surfaces of said balls engage in rolling manner, the surface of the bore in which the slide valve operates, the grooves preferably being segments of an arc and respectively formed in opposite side portions of the slide valve but terminating short of the bottom thereof.

Details of the present invention and other objects thereof are set forth hereinafter in the accompanying specification and illustrated in the drawings comprising a part thereof.

BRIEF DESCRIPTION OF THE DRAWINGS

FIG. 1 is a perspective exploded view showing an exemplary housing of a screw conveyor in which the rotors have been omitted and an exemplary slide valve which includes one embodiment of anti-friction means being shown removed from the cylindrical bore therefor in the housing.

FIG. 2 is an enlarged end view of the housing shown in FIG. 1 and illustrating one embodiment of the invention with respect to the cylindrical bore for the slide valve.

FIG. 3 is an end view of a slide valve of the type to be used with the housing shown in FIG. 2.

FIG. 4 is a side view of the slide valve shown in FIG. 3 and the operating shaft therefor being fragmentarily illustrated.

FIG. 5 is a fragmentary vertical sectional view of the cylindrical bore for the slide valve as seen on the line 5—5 of FIG. 2.

DETAILED DESCRIPTION OF THE PREFERRED EMBODIMENTS

Figure 6:
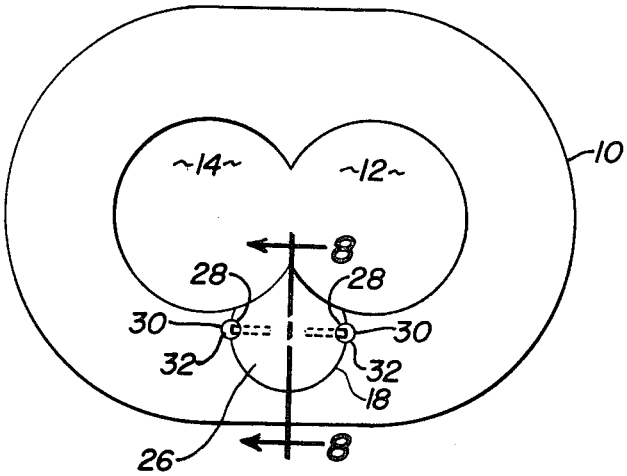
FIG. 6 is an end view of another embodiment of screw compressor housing similar to that shown in FIG. 2 but showing another embodiment of slide valve and anti-friction support means therefor from that shown in FIGS. 2-5.

There is illustrated in FIG. 1, in exploded manner, a typical screw compressor housing 10 of the type commonly employed in the screw compressor art. For further details of this class of compressors, attention is directed to the aforementioned pertinent prior patents, and it is believed that the present illustration is adequate to afford a disclosure and understanding of the present invention.

In FIG. 1, a preferred embodiment of the invention is shown in the form of the housing 10, which is a casting of appropriate metal, a pair of complementary intersecting bores 12 and 14 within which a pair of coacting male and female helical screw rotors, not shown, but of the type also shown in said aforementioned patents, being formed in said casting.

It is customary in compressors of the aforementioned type to employ a slide valve 16, which is accommodated longitudinally within a complementary cylindrical bore 18, the upper portion of which intersects, commonly, portions of the bores 12 and 14, due to the fact that the upper portion 20 of the slide valve 16, which is somewhat pagoda shaped, coacts with the cylindrical outer surfaces of the cooperating male and female rotors referred to above. It is the principal object of the present invention to provide means to support the slide valve 16 within the bore 18 in a manner which minimizes frictional engagement between the two, due particularly to the fact that the slide valve 16 is subjected to substantial pressures during the operation of the compressor as the coacting male and female rotors rotate to effect suitable compression of fluids, and especially gaseous fluids by the compressor. Accordingly, one preferred embodiment of such friction-eliminating means is illustrated in FIGS. 1–5, details of which are as follows:

Referring particularly to FIGS. 1, 2 and 5, it will be seen that opposite side portions of the cylindrical bore 18 are provided with longitudinal grooves 22 which are parallel and open toward each other, said grooves being of predetermined length, of which one typical example is shown in FIGS. 1 and 5. The grooves 22 are for purposes of accommodating rotatable members comprising rollers 24 which are complementary to the grooves 22, and the diameters and pivots of said rollers are such that when they engage the lower surfaces of the grooves 22, as viewed in FIG. 2, they will preferably support the slide valve relative to the bore 18 in such manner that the sliding frictional engagement of the lower portions of the slide valve 16 will be minimal with respect to the complementary surfaces of the bore 18. Any suitable form of additional anti-friction means, such as by the rollers 24 comprising, for example, the outer races of anti-friction ball bearing assemblies may be used. Further, by the provision of longitudinally spaced rollers, support of the slide valve 16 within the bore 18 will be of a parallel nature.

Figure 7:
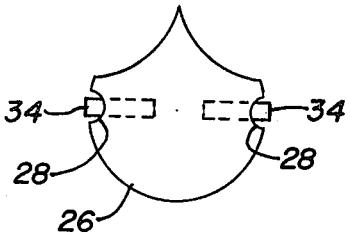
FIG. 7 is an end view of the slide valve shown in FIG. 6.
Figure 8:
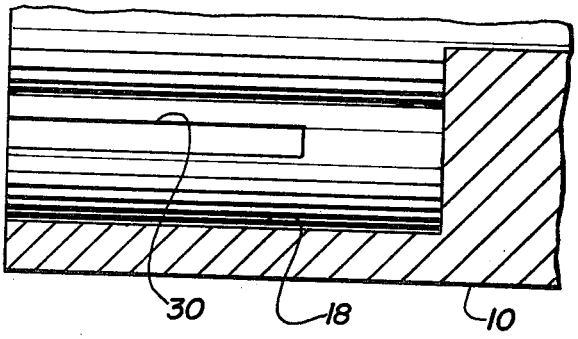
FIG. 8 is a fragmentary vertical sectional view of the cylindrical bore for the slide valve of FIG. 7 in the housing shown in FIG. 6, as seen on the line 8—8 of FIG. 6.
Figure 9:
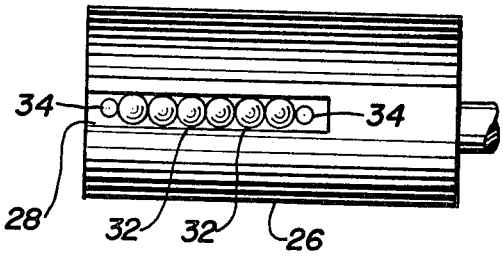
FIG. 9 is a side view of the slide valve shown in FIG. 6 and illustrating anti-friction members mounted in one of the grooves on the side thereof, the operating shaft for the slide valve being shown fragmentarily in said figure.

Referring to FIGS. 6–9, a further embodiment of desirable type of the present invention is illustrated in which the housing 10 is similar to that illustrated in FIGS. 1 and 2, and includes similar bores 12 and 14 which intersect and with which the cylindrical bore 18 also intersects in the upper portion thereof. However, the slide valve 26 is provided along opposite sides thereof with grooves 28 which are substantially semicircular in cross-section, as best shown in FIG. 7. Said grooves are complementary to and cooperate with additional grooves 30 formed respectively in opposite sides of the cylindrical bore 18 in such manner that when the slide valve 26 is disposed within the cylindrical bore 18, the grooves 28 in the slide valve will be directly opposite the corresponding grooves 30 in the bore 18 for purposes of accommodating a plurality of similar rotatable spherical elements or rollers specifically illustrated as ball bearings 32, which are commonly accommodated within the coacting and cooperating grooves 28 and 30. For purposes of retaining the rows of the spherical rollers 32 within the grooves, appropriate retaining means, such as threaded studs 34 are threadably secured within the grooves 28 of the valve 26 respectively adjacent opposite ends of the rows of spherical rollers 32.

As in regard to the anti-friction rollers 24 of the embodiment illustrated in FIGS. 1–5, the diameters of the spherical rollers 32 and the position of the cooperating grooves 28 and 30 which accommodate the same are calculated with respect to the opposing surfaces of the valve 26 and bore 18 so that the frictional engagement between said surfaces is minimal and the provision of the horizontal rows of the anti-friction spherical rollers 32 is such as to maintain the valve 26 parallel with respect to the bore 18.

Figure 10:
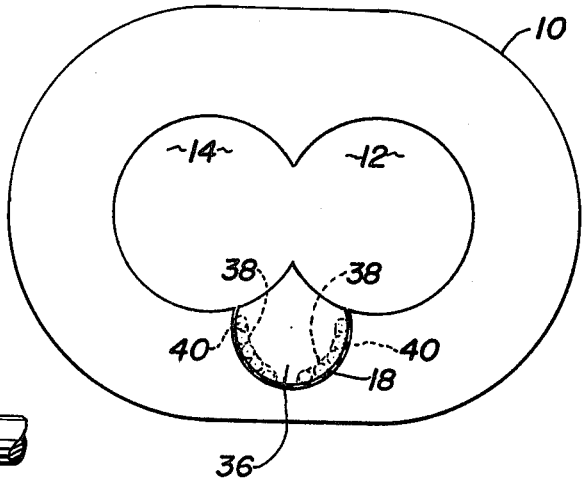
FIG. 10 is an end view similar to FIGS. 2 and 6 and illustrating a still further embodiment of the invention in the form of a slide valve in which transversely extending arcuate grooves are formed to accommodate a series of anti-friction balls in each groove, said grooves comprising segments of an arc and the anti-friction balls engaging the arcuate surface of the cylindrical bore for the slide valve in the housing.
Figure 11:
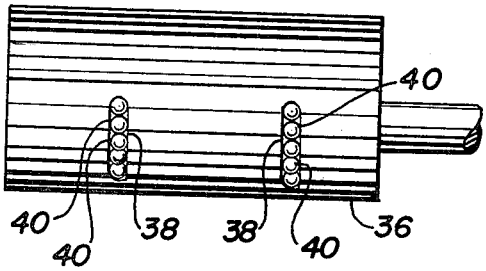
FIG. 11 is a side view of the slide valve shown in FIG. 10 and illustrating fragmentarily an end portion of the operating shafts for the slide valve.

A still further embodiment of the invention is illustrated in FIGS. 10 and 11 in which the housing 10 is generally similar to the housing illustrated respectively in FIGS. 1, 2 and 6 of the above-described embodiment, said housing being provided with similar intersecting bores 12 and 14 for accommodating the aforementioned coacting male and female rotor, the bores intersecting each other and also being intersected by the cylindrical bore 18 which also is similar to the corresponding bore in the preceding embodiments. For purposes of supporting the slide valve 36 within the bore 18 in an anti-friction manner with minimal frictional engagement between the slide valve and bore, this embodiment of the invention includes longitudinally spaced pairs of segmental arcuate grooves 38 formed in opposite surfaces of the slide valve 36, said segmental grooves being complementary to limited rows of anti-friction spherical rollers 40. In the preferred construction of this embodiment of the invention, at least the root portions of the segmental arcuate grooves 38 are complementary to the spherical rollers 40 and the depth of said grooves with respect to the diameters of the rollers is slightly less than that of the rollers in order that a very limited portion of the outermost surfaces of the rollers will contact the bore 18 in a manner to minimize any frictional engagement between the opposite surfaces of the slide valve 36 and the bore 18. Further, by providing longitudinally spaced pairs of the arcuate grooves 38 and the spherical rollers therein, the slide valve 36 will be maintained parallel to the bore 18. As shown, grooves 38 are transverse to the valve axis.

From the foregoing, it will be seen that the various embodiments of the invention all commonly provide anti-friction type support of slide valves within the cylindrical bores therefor in the housings of screw compressors in such manner that normal friction between the slide valve and the cylindrical bore therefor is minimized without impairing the normal desired seal between the opposite coacting surfaces thereof and otherwise minimizing the energy required to shift said valve within said bore for varying the capacity of the compressor.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A screw compressor comprising a pair of coacting helical screw rotors operable within complementary intersecting bores within a housing, and a slide valve axially movable in parallelism with the axes of said rotors within a substantially cylindrical bore formed in said housing below and partially intersecting said complementary intersecting bores, said side valve forming a continuation of said intersecting bores so as to be closely adjacent the screw rotors, in combination with rotatable anti-friction means mounted in at least one longitudinal groove in said cylindrical bore for horizontal operation between said cylindrical bore and slide valve longitudinally of the axis thereof and operable to prevent rotation of said slide valve about its longitudinal axis and to support said slide valve relative to said cylindrical bore and minimize friction therebetween, thereby minimizing the force required to move said slide valve axially within said cylindrical bore.

2. The screw compressor according to claim 1 further characterized by said anti-friction means comprising parallel grooves extending axially along opposed sides of said cylindrical bore in said housing, said grooves being positioned in the walls of said cylindrical bore at equal distances from a plane axially bisecting said cylindrical bore and the intersection of said intersecting bores for said rotors, and said anti-friction means further including rotatable members engaging opposite sides of said slide valve and movable respectively along said grooves.

3. The screw compressor according to claim 2 in which said rotatable members engaging said slide valves comprise a plurality of rollers movable on axle pins transverse to the axis of said slide valve and spaced longitudinally along the same on opposite sides of said slide valve.

4. The screw compressor according to claim 2 further characterized by said anti-friction means including additional grooves extending longitudinally along the opposite sides of said slide valve respectively opposite the grooves in the sides of said cylindrical bore, and opposite portions of said rotatable members being disposed respectively in said opposed grooves in said slide valve and bore.

5. The screw compressor according to claim 4 in which the grooves in said cylindrical bore and slide valve are complementary and said rotatable members comprising a plurality of spherical balls of similar size complementary to the opposed grooves in said bore and slide valve.

6. The screw compressor according to claim 5 in which said slide valve has a predetermined length of movement within said cylindrical bore and the length of the grooves in said slide valve and bore is proportional to said length of movement to insure that said balls will be retained within said grooves during the full predetermined length of travel of said slide valve in said bore.

7. The screw compressor according to claim 6 in which said bore has an open outer end within which said slide valve is inserted and said grooves in said sidewalls of said bore being open at the outer end but the opposite ends of the grooves in said slide valve being closed.

* * * * *